US005746082A

United States Patent [19]

Matsuoka

[11] Patent Number: 5,746,082

[45] Date of Patent: May 5, 1998

[54] THIN SHEET FORMING DIE ASSEMBLY INCLUDING LOWER DIE CYLINDRICAL MEMBER HAVING VARIED DIAMETERS

[75] Inventor: Mitsuo Matsuoka, Hirakata, Japan

[73] Assignee: Umix Co., Ltd., Osaka, Japan

[21] Appl. No.: 795,779

[22] Filed: Feb. 5, 1997

[51] Int. Cl.[6] ..... B21D 5/04

[52] U.S. Cl. ..... 72/313; 72/319; 72/387; 72/452.9

[58] Field of Search ..... 72/312, 313, 314, 72/315, 319, 386, 387, 388, 452.9

[56] References Cited

U.S. PATENT DOCUMENTS

| | | | |
|---|---|---|---|
| 4,365,500 | 12/1982 | Klukow | 72/319 |
| 4,535,619 | 8/1985 | Gargrave | 72/313 |
| 4,558,582 | 12/1985 | Meinig | 72/387 |
| 4,875,356 | 10/1989 | Boardman et al. | 72/319 |
| 5,347,838 | 9/1994 | Matsuoka | 72/313 |

FOREIGN PATENT DOCUMENTS

| | | | |
|---|---|---|---|
| 0197318 | 11/1984 | Japan | 72/313 |
| 63-41652 | 8/1988 | Japan . | |

*Primary Examiner*—David Jones

*Attorney, Agent, or Firm*—Birch, Stewart, Kolasch & Birch, LLP

[57] ABSTRACT

A die assembly includes a forming portion to form a negative angle portion when an upper die is lowered in a straight line to abut a lower die. A cylindrical rotating cam with a groove formed therein in the axial direction is rotatably mounted in the lower die. A negative angle forming portion is formed in the groove edge portion of the rotating cam. A slide cam with a negative angle forming portion is mounted on the upper die in such a manner to be opposed to the rotating cam to enable the removal of the workpiece from the lower die after the forming process is completed. The rotating cam includes a plurality of cylindrical portions of varying diameters whereby an excessively bent negative angle forming portion may be formed by a single rotating cam.

10 Claims, 8 Drawing Sheets

THIN SHEET FORMING DIE ASSEMBLY INCLUDING LOWER DIE CYLINDRICAL MEMBER HAVING VARIED DIAMETERS

BACKGROUND OF THE INVENTION

1. Field of the Invention

The invention relates to thin sheet forming dies.

2. Description of the Prior Art

Negative-angle forming of thin sheets such as sheet metal or plastics is generally performed using a slide cam.

Negative-angle forming referred to herein means such forming which produces a formed portion that enters a lower die from a working locus of an upper die when a workpiece placed on the lower die is formed by lowering the upper die in the vertical direction for abutting against the lower die.

In the conventional negative-angle forming of thin sheet products, the workpiece is placed on the lower die and the upper die descends downwards in the vertical direction to drive a driven cam of the lower die by a driving cam of the upper die, and the workpiece is processed from the lateral direction. When processing is complete and the upper die ascends, the driven cam is retracted by springs to its original position.

In this case, the forming portion of the driven cam which slides in from a position laterally outward from the workpiece and forms the workpiece is formed with an integrated profile identical to that of the workpiece. However, the forming portion of the lower die to be loaded with the workpiece must be designed to separate and retract the negative-angle forming portion of the lower die, or the rear portion forming the negative-angle is deleted and the work must be moved forward to enable the removal of the workpiece. When the negative-angle is small, no serious problems occur. However, when the negative-angle is large, or the product has a slender frame-like cross section with grooves, for example, parts such as an automobile front pillar outer, due to the narrow groove width of the workpiece, not only is the profile unable to be clearly formed at the forming portion of the driven cam when the negative-angle forming portion of the lower die is divided or deleted, but also the diminished strength of the lower die made it impossible to carry out the negative-angle forming process.

In negative-angle forming using the slide cam, the driven cam is slid over a considerably long straight distance, thus it is not always easy to repeatedly slide the driven cam exactly to a specified position and it is difficult to produce products with stable quality. In addition, there are cases in which distortion or bending is generated in products, and the products must be touched up. However, it is practically impossible to touch up products composing the automobile outer plate portions such as side panels, front fenders, roofs, bonnets, trunk lids, door panels, or front pillar outers, because they have three-dimensional curved surfaces and profiles. In the case of automobile sheet metal assembly, if any distortion or bending is generated in the products, it is difficult to combine such products with other parts, and it is not possible to provide a high-quality automobile sheet metal structure or to maintain a specified product accuracy of thin-plate formed products.

When the slide cam is used, a large driven cam and heel must be mounted on the side portion of the lower die where the workpiece is loaded, requiring a large lower die area, increasing the die weight, and resulting in expensive dies.

Therefore, in order to solve the above problems, a forming die and a method of forming thin sheets in which the linear upward and downward motion of a press is converted into rotary motion has been proposed by the present applicant in Japanese patent Publication No. Sho 63-41652.

Referring now to FIGS. 4–8, the forming dies of the prior art will be described in further detail.

FIGS. 4A and 4B show left and right schematic perspective views, respectively, of a complete front pillar outer, and automobile sheet metal part formed by the forming dies. This front pillar outer constitutes part of the front door frame, also part of the front windshield frame, and in addition, part of the frame supporting the roof panel. Therefore, it has a number of connections with many parts, and this is a product for which severe product accuracy is required. If the required accuracy is not satisfied, it is not possible to provide a sheet metal car body with good quality.

Because the front pillar outer composes the outer plate portion of the automobile, it has three-dimensional curved surfaces and profiles.

The portion with the negative-angle formed by this forming die is designated with the letter F, whose cross section is shown as the workpiece W in FIG. 8.

That is, after the negative-angle is formed, the workpiece W achieves the condition shown in FIG. 8 from the condition shown in FIG. 5. The press-working process includes drawings which takes place first, then, peripheral trimming is performed such that the workpiece achieves the condition shown in FIG. 5, and this forming process as described herein is performed as the succeeding third process.

With respect to the lower die 100, a cylindrical rotating cam 102 formed with an axial groove 101 is rotatably mounted to the lower die body 103. The lower die body 103 is securely fixed to the lower substrate 121 with a bolt 122. The top surface of the lower die body 103 is formed in a shape that can receive the workpiece W, and a negative-angle forming portion 104 is formed at the edge portion of the axial groove 101 of the rotating cam 102 nearest to the top surface of the lower die body 103. An automatic return device 105 which rotates and retracts the rotating cam 102 is embedded in the lower die body 103 so that the workpiece W can be removed from the lower die body 103 after the forming process. In this example, the automatic return device 105 brings a push pin 107 biased by a coil spring 106 in contact with the bottom surface of the tip end of a rolling plate 108 securely fixed to the surface of the axial groove 101 of the rotating cam 102 by a bolt 151 at a location opposite to the negative-angle forming portion 104. For the automatic return device 105, pneumatic devices, hydraulic devices, link mechanisms, cams, or other similar mechanisms may be used, and may be mounted not only to the lower die 100 but also between an upper die 109 and the lower die 100.

On the other hand, to the upper die 109, a slide cam 110 is mounted at a position opposite to the rotating cam 102. This slide cam 110 has a negative-angle forming portion 112 formed at the bottom end thereof. The slide cam 110 is guided by a guide (not illustrated), and the slide cam 110 is biased in the outward direction of the die by a coil spring 117 compressedly mounted between the slide cam 110 top surface and an inclined guide 154 bottom surface securely fixed to the top substrate 152 with a bolt 153. The slide cam 110 is stopped by a stopping plate 156 securely affixed to the inclined guide 154 with a bolt 155. A pad 157 energized downwards by a coil spring 158 is suspended from the top substrate 152 by a bolt 119, and strongly presses the workpiece W against the lower die body 103 to prevent the workpiece W from moving before the negative-angle is formed bon the workpiece W.

Next, the operation of this prior art forming die will be described.

First of all, as shown in FIG. 5, the upper die 109 is located at the top dead center, and then, the workpiece W is loaded on the lower die body 103 of the lower die 100. At this time, the rotating cam 102 is rolled and retracted by the automatic return device 105.

Then, the upper die 109 begins descending and as shown in FIG. 6, the bottom surface of the slide cam 110 comes in contact with the rolling plate 108 to rotate the rotating cam 102 clockwise in FIG. 6 without causing the slide cam 110 to interfere with the negative-angle forming portion 104 of the rotating cam 102.

As the upper die 109 continues to descend further, the slide cam 110 energized in the outward direction of the die resists against the energizing force of the coil spring 117, moves to the left in the lateral direction by the operation of the cam, enters the state shown in FIG. 7, and the negative-angle forming portion 104 of the rolled rotating cam 102 cooperates with the negative-angle forming portion 112 of the slide cam 110 to form the negative-angle portion on the workpiece W.

After the negative-angle portion is formed, the upper die 109 begins rising. The slide cam 110 is biased in the outward direction of the die by the coil spring 117, moves to the right in FIG. 8, and ascends without interfering with the workpiece W with the negative-angle portion formed thereon.

On the other hand, the rotating cam 102 rotates to the right in FIG. 8 by the automatic return device 105 because the slide cam 110 ascends, enabling the workpiece W to be removed without interfering with the negative-angle forming portion 104 of the rotating cam 102 when the negative-angle formed workpiece W is removed from the lower die body 103.

Thin sheet products with the negative-angle formed thereon have been made using the rotating cam described above. As the rotating cam rotates around the rotation axis to process the workpiece W, if the workpiece W is nearly linear and is not greatly curved, the negative-angle forming portion can enter one of the cylindrical rotating cams in the same diameter and is able to form the workpiece W with a negative-angle portion. However, if the workpiece W is greatly curved, the workpiece W is unable to completely enter one of the cylindrical rotating cams in the same diameter to form the negative-angle portion, and is therefore unable to be processed.

In particular, automobile sheet metal parts including door panels have many curved portions, and in recent years, there are many parts having negative-angle portions. From the viewpoint of designs, in addition to conventional curved portions, it is desired to form these negative-angle portions in one process without undergoing many processes, whereby the production efficiency is improved.

SUMMARY OF THE INVENTION

This invention relates to a forming die for forming a greatly bent negative-angle forming portion on thin sheets with one rotating cam equipped with a plurality of cylindrical rotating cam portions in varying diameters.

The size of the rotating cam diameter cannot be practically excessively increased from the viewpoint of fabricating dies, and is, for example, about 320 mm. For a greatly bent workpiece, the bent portions are processed by one rotating cam equipped with a plurality of cylindrical rotating cam portions in varying diameters.

The diameters are varied at a required position of the rotation axis in accordance with the degree of the bend of the workpiece. Special consideration shall be given to the size of diameter of the rotating cam so that the negative-angle forming portion of the rotating cam does not become excessively acute. If the negative-angle forming portion becomes excessively acute, the strength decreases, and it is therefore preferable to prevent the angle from becoming 30° or less.

When a plurality of rotating cams are used as in the prior art, their end faces may interfere with one another at the joints of adjoining rotating cams when the rotating cams are rotated. However, the dies according to this invention are completely free of such interference because in this invention, one rotating cam is used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BRIEF DESCRIPTION OF THE PREFERRED EMBODIMENT

Referring now to one specific embodiment shown in FIGS. 1–3, this invention will be described in further detail.

Figure 1:
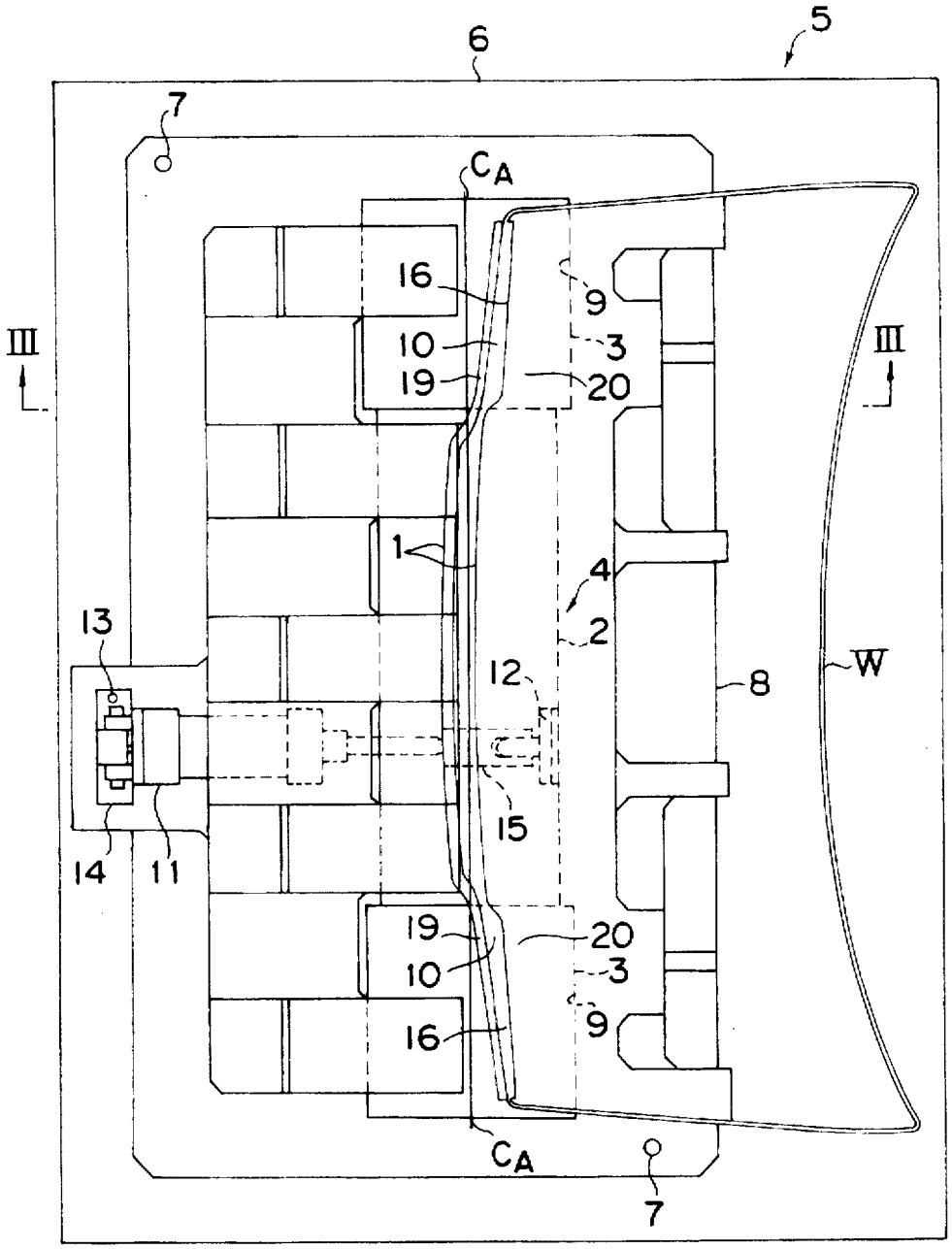
FIG. 1 is a plan view of one specific embodiment according to this invention.
Figure 2A:
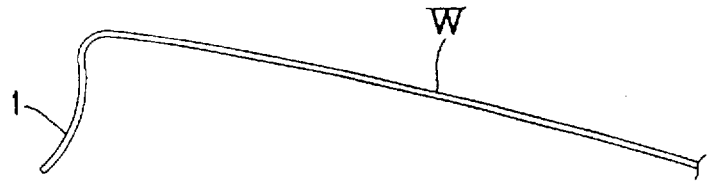
FIGS. 2A and 2B show two cross-sectional views of the workpiece W taken on line III—III of FIG. 1 before and after negative-angle forming.
Figure 2B:
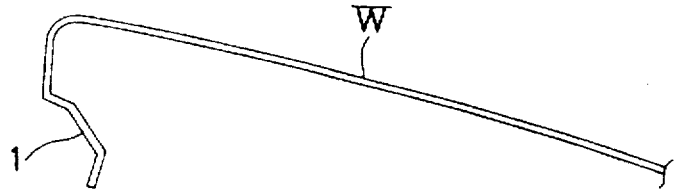

The workpiece W formed by the forming dies according to this invention is an automobile trunk lid outer as shown in FIG. 1. The recessed circular arc curved portion of the front edge portion of the trunk lid outer as showing in plan view is formed with a negative-angle portion.

The processed portion of the workpiece W of the thin sheet forming dies is the rear edge portion of the trunk lid outer. As shown in FIG. 1, it is a protruded form as seen from the plan view, and both end portions are considerably displaced forward. If this is processed with an ordinary one piece rotating cam, an extremely large rotating cam is required. Excessively increasing the size is practically impossible in fabricating dies, and about 320 mm in diameter is the maximum. In addition, the flange angle differs at the center portion and both ends portions, and there is a case in which the negative-angle forming portion of the rotating cam becomes too acute to maintain the necessary strength. In this invention, the rotating cam is formed into a small-diameter rotating cam portion at the center portion and large-diameter rotating cam portions at both ends.

On both ends of a central small-diameter rotating cam portion 2 are arranged rotating cams 3 comprising large-diameter rotating cam portions 3. As is clear from FIG. 3, the large-diameter rotating cam portions 3 are concentric to the small-diameter rotating cam portion 2 for rotation about axis CA, and has a larger diameter than that of the small-diameter rotating cam portion 2. For example, the diameter of the large-diameter rotating cam portions 3 is 290 mm, and that of the small-diameter rotating cam portion 2 is 250 mm.

The lower die 5 has a support block 8 fixed to the lower die base 6 with a bolt 7, and rotatably supports the large-diameter rotating cam 3 in a horizontal slot groove 9 of the support block 8. A groove 10 is formed axially in the rotating cam 4.

In this embodiment, an air cylinder 11 is utilized as an automatic return device for the rotating cam 4 in FIG. 1. Needless to say, the automatic return device is not limited to an air cylinder, but a spring, hydraulic equipment, link mechanism, cam or any mechanisms similar to these may be used, and can be mounted not only to the lower die but also to the upper die.

A connecting member 12 is fixed to the bottom surface of the small-diameter rotating cam portion 2, and to the tip end of a piston rod 15 of the air cylinder 11 whose base end is pivotally mounted via a bracket 14 fixed to the support block 8 with a bolt 13. The connecting member 12 is pivotally mounted, so that the piston rod 14 may be contacted to return the small-diameter rotating cam portion 2 to its original position. At the bottom portion of the slot groove 9 of the support block 8, a window slot is provided for allowing the connecting member 12 to pass therethrough.

At the edge portion of the groove 10 of the large-diameter rotating cam portion 3, a negative-angle forming portion 16 is formed. A rolling plate 17 is fixed to the side opposite to the negative-angle forming portion 16 of the groove 10 with a bolt 18. The negative-angle forming portion 16 of the large-diameter rotating cam portion 3 is located partially within a work support portion 19 having a profile the same as the bottom surface of the workpiece W so that the workpiece W is properly supported. A work loading portion 20 having a profile the same as the bottom surface of the workpiece W is formed slightly outwards in the upper portion of the work supporting portion 19.

An upper die 21 has a support block 23 fixed to the lower surface of an upper die base 22 with a bolt 24. A wear plate 25 is fixed to the lower inclined surface of the support block 23 with a bolt 26. A slide cam 27 is held by a guide plate (not illustrated) for sliding movement on the lower surface of the wear plate 25. On the top surface of the slide cam 27, the negative-angle forming portion 28 is fixed with a bolt 29, at a position opposed to the groove 10 of the rotating cam 4.

On the top inclined surface of the slide cam 27, a support plate 36 is fixed with a bolt 30. Between this support plate 36 and a support plate 31 fixed to the support block 23, a coil spring 32 is compressedly mounted to bias the slide cam 27 to the outward direction of the die.

The coil spring 32 is mounted around a positioning pin 33 screwed into the support plate 31, and the tip end of the positioning pin 32 allows a stopping plate 34 fixed to the side surface opposite to the support plate 31 to pass therethrough.

When the upper die 21 rises, the slide cam 27 moves outwards of the die until the support plate 36 comes in contact with the stopping plate 34 by the biasing force of the coil spring 32.

Though it is not illustrated, in order to stably support the workpiece W, a positioning member for the workpiece W is mounted on the lower die 5, and to the upper die 21, as described in the conventional example. A pad for pressing the workpiece W is mounted to the lower die 5, but since inclusion of these elements would make the illustration complicated and essential points of this invention difficult to understand, the positioning member and the pad are omitted from FIGS. 1 and 3.

For processing the center portion of the workpiece W, the small-diameter rotating cam portion 2 is shown with an alternate long and short dashes line, and the features thereof are nearly identical to the large-diameter rotating cam portion 3.

Next, description will be made of the operation of the thin sheet forming dies.

Figure 3:
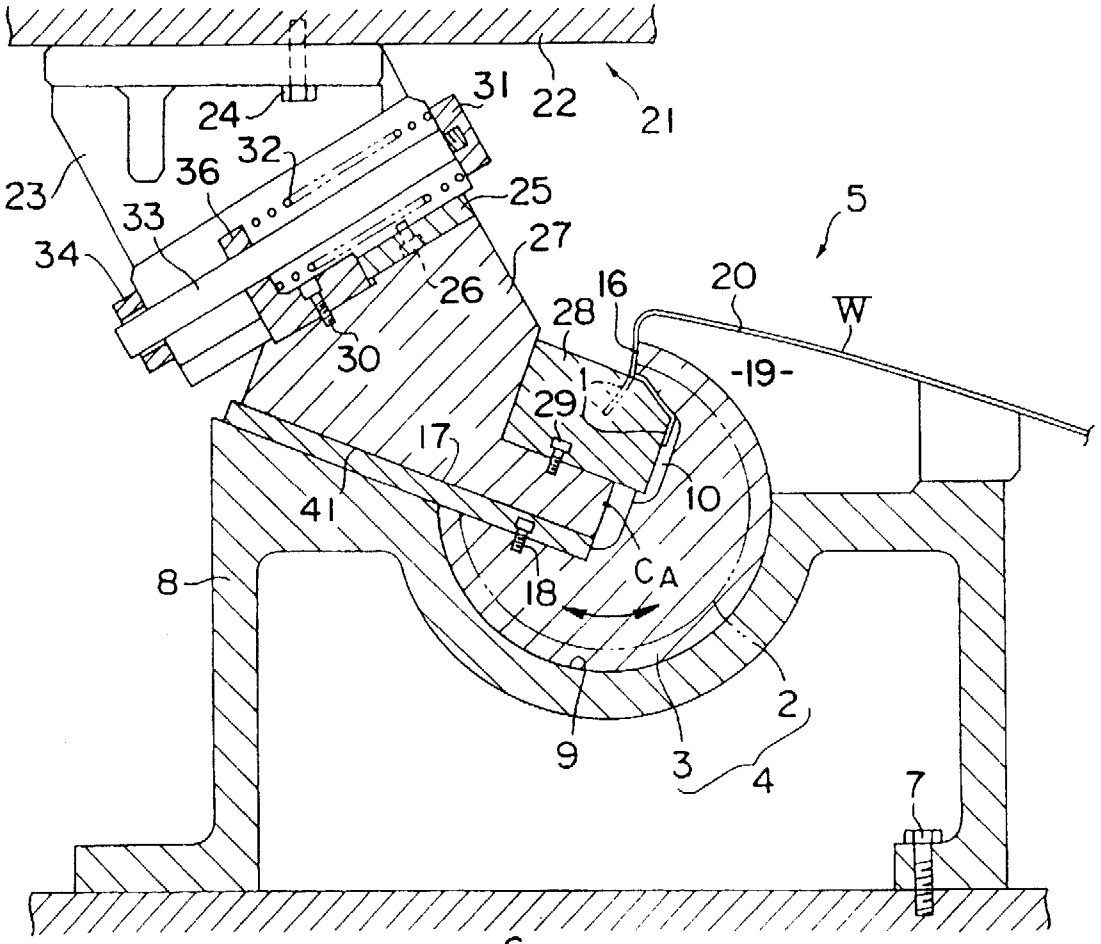
FIG. 3 is a longitudinal cross-sectional view taken on line III—III of FIG. 1.
Figure 4A:
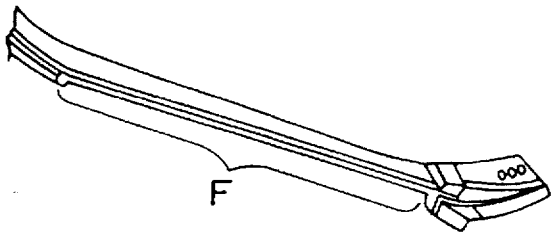
FIGS. 4A and 4B show left and right perspective views, respectively, of the completed front pillar outer of an automobile.
Figure 4B:
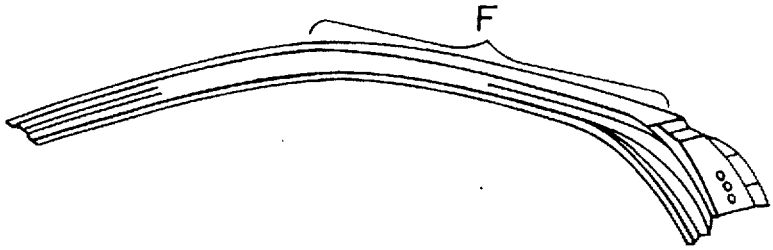
Figure 7:
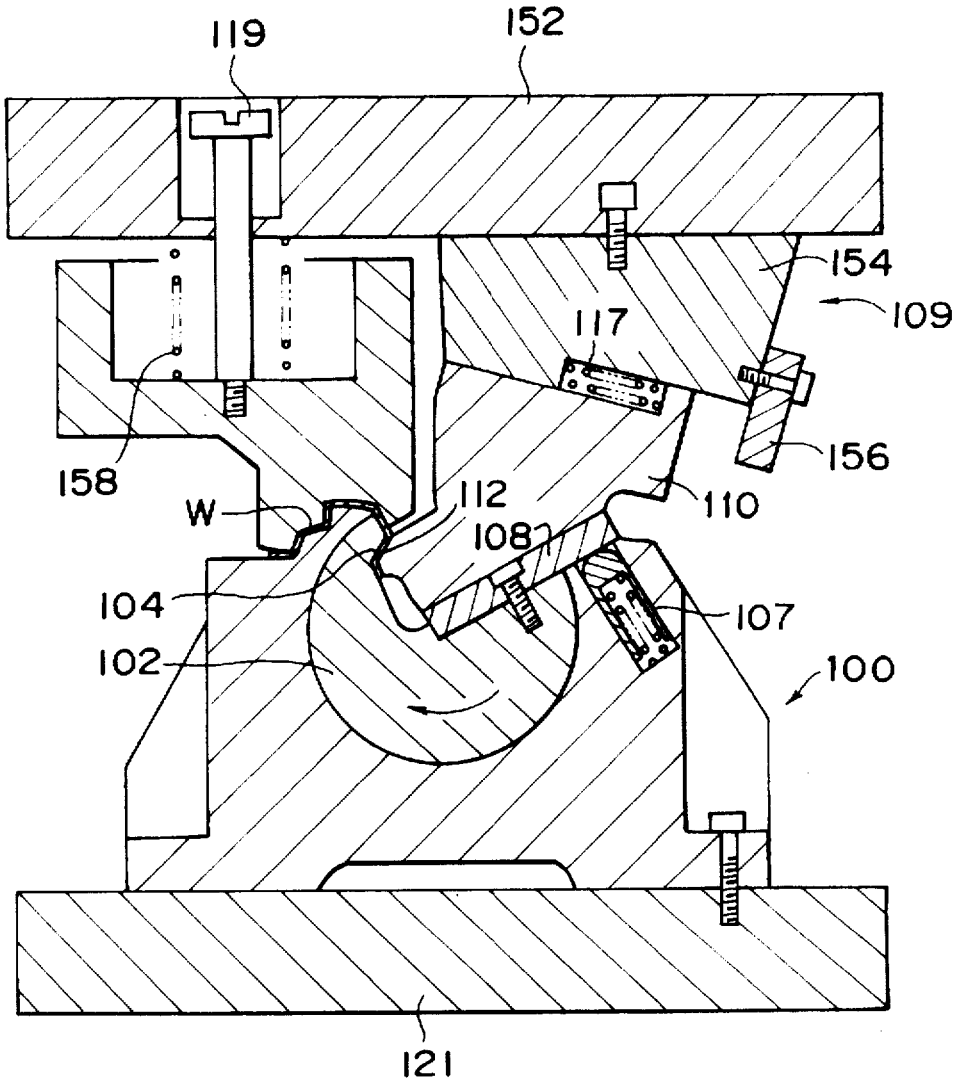
FIG. 7 is a longitudinal cross-sectional view of the die assembly of FIG. 5 in the bottom dead center condition.
Figure 8:
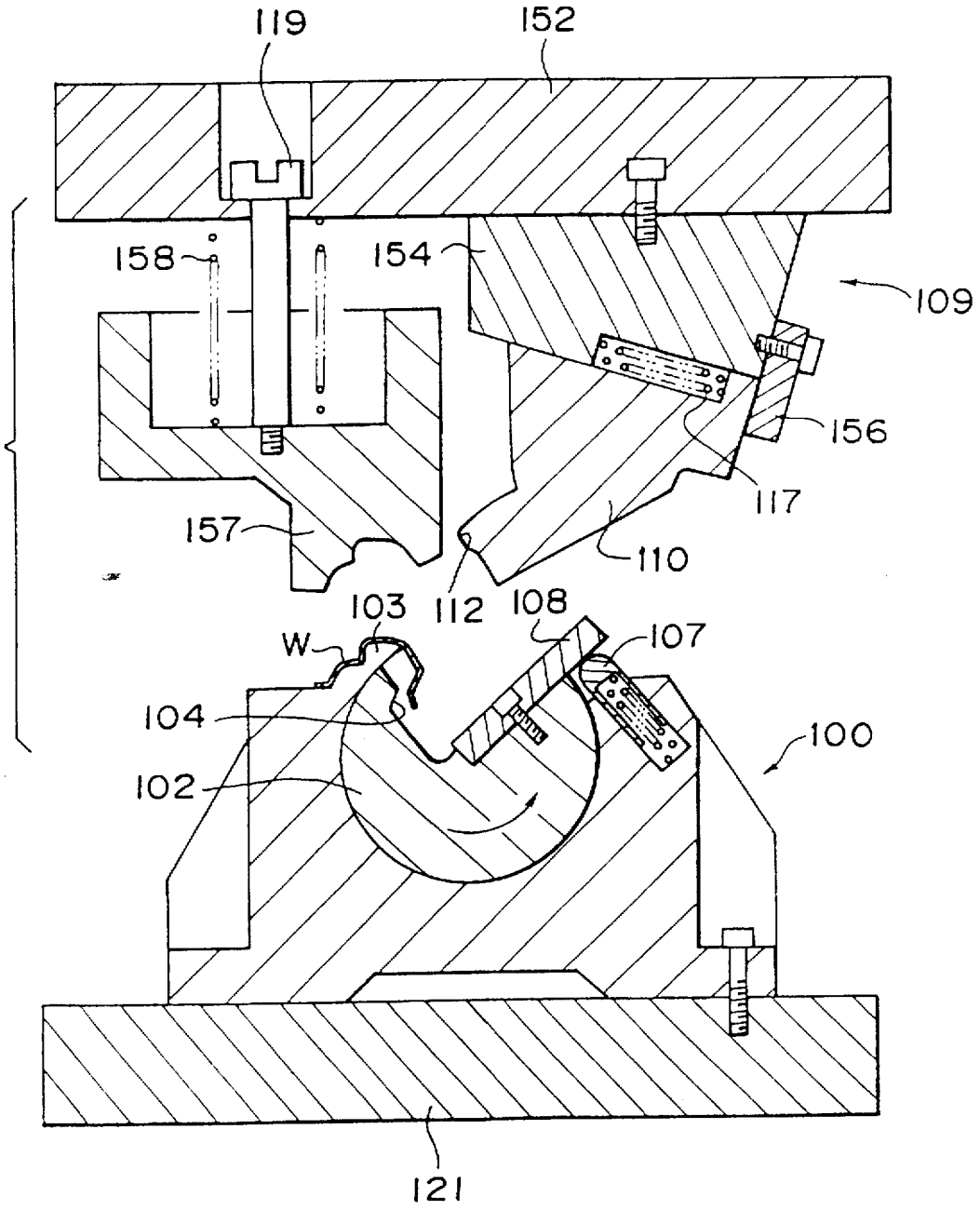
FIG. 8 is a longitudinal cross-sectional view of the die assembly of FIG. 5 showing the workpiece W located on the lower die after the negative-angle forming process is finished.

The condition shown in FIG. 3 is the bottom dead center condition and corresponds to FIG. 7 of the conventional example.

Figure 5:
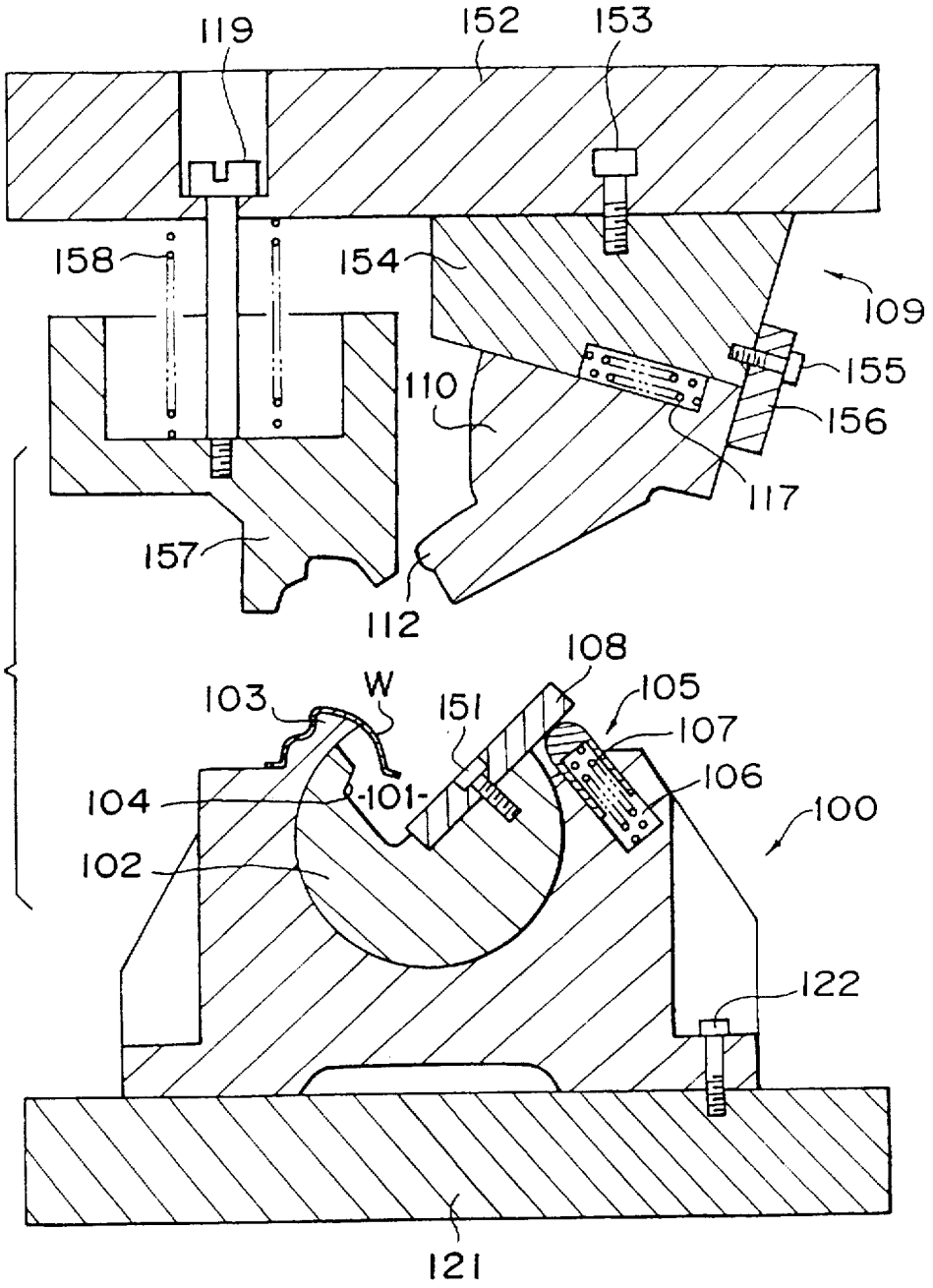
FIG. 5 is a longitudinal cross sectional view of a prior art die assembly when the upper die is in the top dead center condition and showing the workpiece W before processing.

In this invention, it is not illustrated but as shown in FIG. 5 of the conventional example, the upper die 21 is located at the top dead center when the workpiece W is loaded to the work support portions 20 of the lower die 5. At this time, the rotating cam 4 is rolled to a retracted position by the air cylinder 11.

Figure 6:
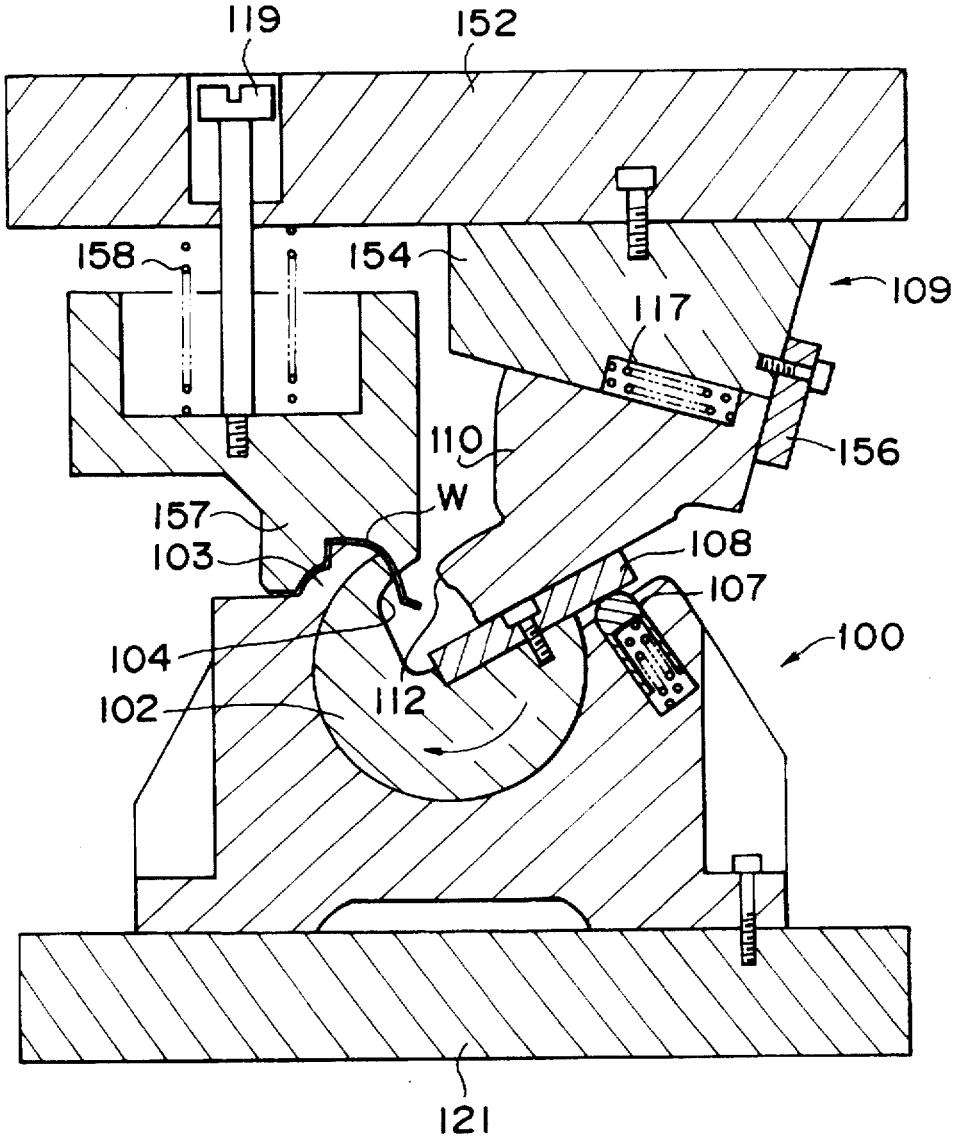
FIG. 6 is a longitudinal cross-sectional view of the die assembly of FIG. 5 which descends to come in contact with the lower die.

Next, in a manner similar to that shown in FIG. 6 of the conventional example, in the upper die 21, the inclined surface 41 of the slide cam 27 comes in contact with the rolling plate 17 without allowing the slide cam 27 to interfere with the negative-angle forming portion 16 of the small-diameter rotating cam portion 2 and large-diameter rotating cam portions 3. This causes the small-diameter rotating cam portion 2 and large-diameter rotating cam portions 3 to rotate counterclockwise.

As the upper die 21 further continues to descend, the slide cam 27 biased in the outward direction of the die assembly against the biasing force of the coil spring 32 and moves to the right in the lateral direction by the action of the cam. As shown in FIG. 3, the negative-angle forming portion 16 of the small-diameter rotating cam portion 2 and the large-diameter rotating cam portions 3 cooperate with the negative-angle forming portion 28 of the slide cam 27 to form the workpiece W with a negative-angle portion.

After the negative-angle portion is formed, the upper die 21 begins to ascend. The slide cam 27 is biased in the outward direction of the die assembly by the coil spring 32, and moves to the left and ascends without interfering with the negative-angle formed workpiece W.

On the other hand, when the slide cam 27 ascends and the air cylinder 11 contracts the piston rod 15, the small-diameter rotating cam portion 2 and the large-diameter rotating cam portions 3 rotate clockwise to enable the removal of the workpiece W without interfering with the negative-angle forming portion 16 of the small-diameter rotating cam portion 2 and the large-diameter rotating cam portions 3, when the negative-angle formed workpiece W is removed from the lower die 5.

The thin sheet forming die according to this invention is particularly suited for negative-angle forming the protruded circular arc curved portion of the workpiece W as seen from the plan view of FIG. 1. This is because the flange to be formed becomes a shrinkage flange as it is protruded and tends to generate wrinkles as the time of forming, requiring bottom pushing processing. In this invention, because the rotating cams are formed integrally, bottom pushing forming is possible with high accuracy.

Because an excessively bent negative forming section is formed by a plurality of varied diameter portions in this invention, it is possible to prevent the negative-angle forming portions of the rotating cams from being excessively acute, and the rotating cams may therefore remain strong.

In addition, when a plurality of rotating cams are used as in the prior art, their end faces may interfere with one another at the joints of adjoining rotating cams when the rotating cams are rotated. However, the dies according to this invention are completely free of such interference because in this invention, one rotating cam is used, which has portions of varied diameters.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A pressing apparatus comprising a lower die having a supporting portion for supporting a metal sheet material to be worked and an upper die movable in a path downwardly and linearly with respect to said lower die to abut on the material to be worked, so as to shape the material to be worked, said pressing apparatus further comprising:

at least one cylindrical member having an outer surface being rotatably disposed in said lower die adjacent said supporting portion, said cylindrical member having a groove opening to said outer surface and extending along its axial extent and a recess forming portion formed at an edge portion of said groove near to said supporting portion and stepped inside from said path of said upper die;

a slide cam having a recess forming portion and slidably arranged on said upper die for confronting said cylindrical member; and an automatic return element, provided in said lower die, for rotationally returning said cylindrical member to a starting position at which said material after being shaped can be taken out from said lower die, wherein said material to be worked is placed on said supporting portion of said lower die and is shaped by said recess forming portion of said cylindrical member by sliding movement of said recess forming portion of said slide cam, and thereafter said cylindrical member is rotationally returned to said starting position by said automatic return element so that the worked material can be taken out from said lower die, and wherein said at least one cylindrical member comprises a plurality of cylindrical members in varying diameters.

2. A pressing apparatus comprising:

an upper die and a lower die, said upper die and said lower die being movable relative to one another;

said lower die including a workpiece support, said lower die further including a cylindrical member rotatable with respect to said workpiece support, said cylindrical member including first and second cylindrical member portions having different diameters and rotatable about a common axis of rotation, said first and second cylindrical member portions having an axially extending groove therein including first forming portions; and said upper die including a slide cam slidable thereon, said slide cam having second forming portions thereon at locations opposed to said first forming portions, whereby displacement of said upper die toward said lower die causes said slide cam and said second forming portions to move toward said first forming portions of said cylindrical member portions to thereby shape a portion of a workpiece which is located between said first and second forming portions.

3. The pressing apparatus according to claim 2, wherein said cylindrical member further includes a slide cam engaging member extending outwardly therefrom which is engagable by said slide cam to cause said cylindrical member to rotate.

4. The pressing apparatus according to claim 2, further including a return device for returning the cylindrical member to a position where the workpiece may be removed from the lower die.

5. The pressing apparatus according to claim 4, wherein said return device comprises an air cylinder.

6. The pressing apparatus according to claim 5, wherein said air cylinder includes a rod having a distal portion pivotally attached to a connecting member extending from said cylindrical member.

7. The pressing apparatus according to claim 6, wherein said connecting member extends through an opening provided in a lower wall of said lower die.

8. The pressing apparatus according to claim 7, wherein said cylindrical member further includes a slide cam engaging member extending outwardly therefrom which is engagable by said slide cam to cause said cylindrical member to rotate.

9. The pressing apparatus according to claim 2, wherein said first and second cylindrical member portions include a central portion having a first diameter, and a pair of end portions having a second diameter larger than said first diameter.

10. A pressing apparatus comprising:

an upper die and a lower die, said upper die and said lower die being movable relative to one another;

said lower die including a workpiece support, said lower die further including a cylindrical member rotatable with respect to said workpiece support, said cylindrical member including a central portion having a first diameter, and a pair of end portions having a second diameter larger than said first diameter, said central portion and said end portions rotatable about a common axis of rotation, said central portion and said end portions having an axially extending groove therein including first forming portions;

a return device for returning the cylindrical member to a position where the workpiece may be removed from the lower die, said return device comprising an air cylinder, said air cylinder including a rod having a distal portion pivotally attached to a connecting member extending from said cylindrical member through an opening provided in a lower wall of said lower die;

said upper die including a slide cam slidable thereon, said slide cam having second forming portions thereon at locations opposed to said first forming portions;

said cylindrical member further including a slide cam engaging member extending outwardly therefrom which is engagable by said slide cam to cause said cylindrical member to rotate, whereby displacement of said upper die toward said lower die causes said slide cam and said second forming portions to move toward said first forming portions of said central portion and said end portions to thereby shape a portion of a workpiece which is located between said first and second forming portions.

* * * * *